US006988373B2

(12) United States Patent
Wakatsuki

(10) Patent No.: US 6,988,373 B2
(45) Date of Patent: Jan. 24, 2006

(54) METHOD FOR OPERATING AUTOMATIC ICE-MAKING MACHINE

(75) Inventor: Yuji Wakatsuki, Toyoake (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 0 days.

(21) Appl. No.: 10/897,140

(22) Filed: Jul. 22, 2004

(65) Prior Publication Data

US 2005/0016190 A1 Jan. 27, 2005

(30) Foreign Application Priority Data

Jul. 24, 2003 (JP) ..... 2003-279370

(51) Int. Cl.
*F25C 1/12* (2006.01)

(52) U.S. Cl. ..... 62/74; 62/233

(58) Field of Classification Search ..... 62/66–74, 62/216, 233, 340–356
See application file for complete search history.

(56) References Cited

U.S. PATENT DOCUMENTS 4,947,653 A 8/1990 Day et al.
5,105,632 A * 4/1992 Naruse ..... 62/233
5,237,837 A * 8/1993 Naruse et al. ..... 62/434
5,239,836 A * 8/1993 Sakai ..... 62/233
5,259,201 A 11/1993 Sakai et al.
5,291,747 A * 3/1994 Sakai et al. ..... 62/135
5,304,904 A * 4/1994 Sakai ..... 318/484
5,878,583 A * 3/1999 Schlosser et al. ..... 62/73

FOREIGN PATENT DOCUMENTS

EP 4-3868 1/1992
EP JP 5-248743 9/1993
GB 2 248 491 4/1992

* cited by examiner

*Primary Examiner*—William E. Tapolcai
(74) *Attorney, Agent, or Firm*—Koda & Androlia

(57) ABSTRACT

When refrigerant shortage has occurred, a failsafe operation, for example, for stopping an ice-making operation is carried out to thereby suppress wasteful electric power consumption and prevent an ice-making section and a compressor from being damaged. An ice-making machine alternately and repeatedly carries out the ice-making operation for producing ice blocks (M) by cooling an ice-making section (10) on which is disposed an evaporator (14) connected to a refrigeration system (12), by supplying refrigerant to the evaporator (14) for circulation, and deicing the operation for causing the ice blocks (M) produced on the ice-making section (10) to be released therefrom. During the ice-making operation, when time in which the outlet temperature of refrigerant from the evaporator (14) takes to reach a first preset temperature K1, after the start of the ice-making operation, is longer than a normal time tn1 in which the outlet temperature of the refrigerant from the evaporator (14) takes to reach the preset temperature K1 the abnormal state of shortage of refrigerant is determined and a failsafe operation is carried out.

2 Claims, 5 Drawing Sheets

METHOD FOR OPERATING AUTOMATIC ICE-MAKING MACHINE

FIELD OF THE INVENTION

This invention relates to a method for operating an automatic ice-making machine that alternately and repeatedly carries out an ice-making operation and deicing an operation to thereby produce a large amount of ice blocks.

PRIOR ART

An automatic ice-making machine that automatically produces a large amount of ice blocks is configured such that an evaporator tube leading out of a refrigeration system including a compressor, a condenser, and the like, is laid out in an ice-making section, ice-making water is supplied to the ice-making section cooled by refrigerant circulating through the evaporator tube to thereby form ice blocks, and the obtained ice blocks are caused to be released from the ice-making section to be dropped for discharge. The automatic ice-making machine includes an ice-making water tank that stores a required amount of ice-making water, and is configured such that ice-making water in the tank is fed to the ice-making section during the ice-making operation by pressure using a circulation pump, and ice-making water left unfrozen is collected in the tank, and sent out again to the ice-making section. Then, when a detecting device detects that after continuous ice-making operation, a water level in the ice-making water tank has been reduced to a predetermined lower water level set in advance, it is determined that ice making by the ice-making section is completed, so that the ice-making operation is switched to a deicing operation in which hot gas discharged from the compressor is supplied to the evaporator tube by switching a valve in the refrigeration system, and water from an external water supply is supplied to the ice-making section as deicing water for being sprinkled onto the ice-making section, to thereby facilitate melting of frozen faces between the surface of the ice-making section and ice blocks. It should be noted that deicing water used for warming the ice-making section is collected in the ice-making water tank to be used as ice-making water during the next ice-making operation.

In the automatic ice-making machine, by taking into account occurrence of a trouble that the ice-making operation cannot be switched to the deicing operation due to the detecting device being incapable of detecting the lower water level because of failure thereof, control is provided such that an ice-making protective timer, which starts its (counting) operation when the water level of deicing water (water used as ice-making water during the next ice-making operation) supplied to the ice-making water tank is increased up to a predetermined upper water level set in advance, i.e. when the ice-making operation is started, terminates counting of time (counts up), the ice-making operation is switched to the deicing operation (see, for example, Japanese Unexamined Patent Publication No. Sho 62-299667).

SUMMARY OF THE INVENTION

Even when the detecting device cannot detect the lower water level, it is possible to switch the ice-making operation to the deicing operation after the lapse of a preset time period, by using the ice-making protective timer. However, even when a refrigeration circuit becomes short of refrigerant, the ice-making operation is continued until a time period set to the ice-making protective timer has elapsed, and hence there remains a problem that electric power is wastefully consumed.

Now, refrigerant shortage leads to variations in growth of ice blocks in the ice-making section. In the above case, when a deicing-detecting device for detecting completion of the deicing operation detects the completion of the deicing operation, there occurs a problem of a faulty deicing operation in which part of the ice blocks remain in the ice-making section without being released to be dropped therefrom. This can damage the ice-making section. Further, there is also pointed out a drawback of the shortage of refrigerant causing an overheated operation of the compressor, which damages the compressor.

The present invention has been made in view of the above problems inherent in the aforementioned prior art to properly solve them, and an object thereof is to provide an operating method for an automatic ice-making machine, which is capable of suppressing wasteful electric power consumption and preventing an ice-making section and a compressor from being damaged, by carrying out failsafe operation, for example, for stopping ice-making operation upon occurrence of refrigerant shortage.

Means for Solving the Problems

To overcome the above problems and attain the above object, in an aspect of the invention, there is provided a method for operating an automatic ice-making machine that alternately and repeatedly carries out an ice-making operation for producing ice blocks by cooling an ice-making section on which an evaporator connected to a refrigeration system is disposed and by supplying refrigerant to the evaporator for circulation, and a deicing operation for causing the ice blocks produced on the ice-making section to be released therefrom, wherein during the ice-making operation, when time in which an outlet temperature of the refrigerant from the evaporator takes to reach a preset temperature, after a start of the ice-making operation, is longer than a normal time in which the outlet temperature of the refrigerant from the evaporator takes to reach the preset temperature, an abnormal state of shortage of the refrigerant is determined and a failsafe operation is carried out.

To overcome the above problems and attain the above object, in an another aspect of the invention, there is provided a method for operating an automatic ice-making machine that alternately and repeatedly carries out an ice-making operation for producing ice blocks by cooling an ice-making section on which an evaporator connected to a refrigeration system is disposed and by supplying refrigerant to the evaporator for circulation, and a deicing operation for causing the ice blocks produced on the ice-making section to be released therefrom, wherein during the ice-making operation, when time in which an outlet temperature of the refrigerant from the evaporator takes to reach a second preset temperature from a first preset temperature is longer than a normal time in which the outlet temperature of the refrigerant from said evaporator takes to reach the second preset temperature, an abnormal state of shortage of the refrigerant is determined and a failsafe operation is carried out.

BEST MODE FOR CARRYING OUT THE INVENTION

In carrying out ice-making operation, when a time which the outlet temperature of refrigerant from an evaporator actually takes to reach a preset temperature after the start of the ice-making operation in a state of the amount of refrigerant in a refrigeration system being normal is longer than a normal time which the outlet temperature of the refrigerant from the evaporator takes to reach the preset temperature after the start of the ice-making operation in the state of the amount of refrigerant in the refrigeration system being normal, it is determined that the abnormal state of shortage of refrigerant has occurred, and failsafe operation is carried out.

Further, in carrying out the ice-making operation, when a time which the outlet temperature of the refrigerant from the evaporator actually takes to reach from a first preset temperature to a second preset temperature after the start of the ice-making operation in the state of the amount of the refrigerant in the refrigeration system being normal is longer than a normal time which the outlet temperature of the refrigerant from the evaporator takes to reach from the first preset temperature to the second preset temperature after the start of the ice-making operation in the state of the amount of refrigerant in the refrigeration system being normal, it is determined that the abnormal state of shortage of refrigerant has occurred, and failsafe operation is carried out.

Next, the operating method for an automatic ice-making machine, according to the present invention, will now be described in detail with reference to the drawings showing preferred embodiments thereof.

(First Embodiment)

Figure 1:
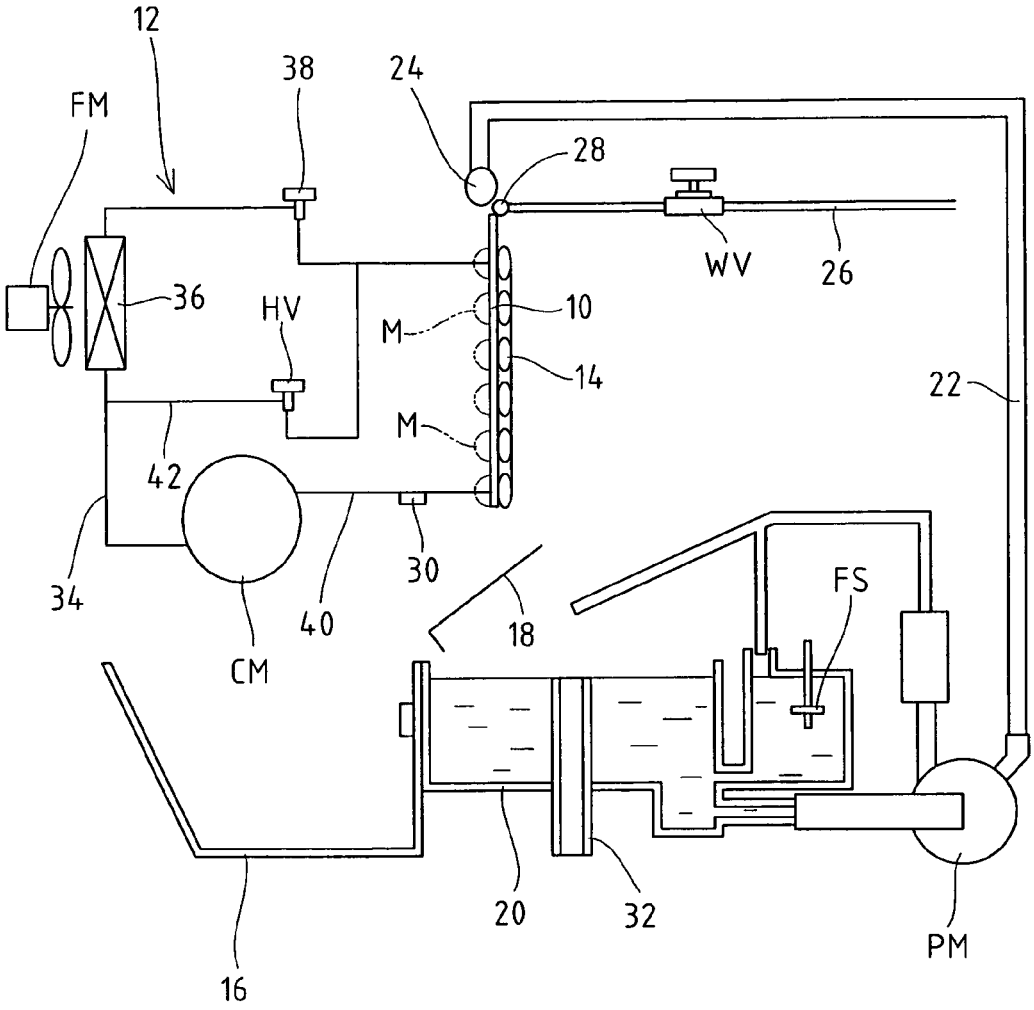
FIG. 1 is a diagram showing the arrangement of a flowing-down type ice-making machine to which an operating method according to a first embodiment of the present invention is applied.

Referring first to FIG. 1, there is schematically shown the arrangement of a flowing-down type ice-making machine as an automatic ice-making machine to which the operating method according to the first embodiment is suitably applied. The flowing-down type ice-making machine is configured such that an evaporator tube (evaporator) 14 leading out of a refrigeration system 12 and extending in a laterally meandering manner is fixed to a back surface of a vertical ice-making plate (ice-making section) 10 in a state in intimate contact therewith, so as to circulate refrigerant during the ice-making operation to thereby forcibly cool the ice-making plate 10. At a location exactly below the ice-making plate 10, a guide plate 18 is disposed at an inclined attitude, for guiding ice blocks M dropped after being released from the ice-making plate 10 by deicing operation, to a stocker 16 disposed at a location obliquely downward of the ice-making plate 10. It should be noted that the guide plate 18 is formed with a large number of through holes such that ice-making water supplied to an ice-making surface (front surface) of the ice-making plate 10 during the ice-making operation, and deicing water supplied to the back surface of the ice-making plate 10 during the deicing operation is collected and stored in an ice-making water tank 20 disposed at a location downward of the guide plate 18 after flowing through the through holes of the guide plate 18.

An ice-making water supply pipe leading out of the ice-making water tank 20 via a circulation pump PM is connected to an ice-making water sprinkler 24 provided above the ice-making plate 10. The ice-making water sprinkler 24 has a large number of sprinkler holes formed therein for sprinkling ice-making water supplied from the tank 20 under pressure from the pump PM during the ice-making operation through the sprinkler holes onto the ice-making surface, cooled to the freezing temperature, of the ice-making plate 10, and causing the same to flow down along the ice-making surface, to thereby produce ice blocks M having a predetermined shape on the ice-making surface.

The ice-making machine shown in FIG. 1 is provided with a deicing water supply system, separately from the above-described ice-making water supply system. More specifically, the ice-making machine is configured such that when the deicing operation is performed, hot gas (high-temperature refrigerant) is circulated through the evaporator tube 14 by switching a hot gas valve HV provided in the refrigeration system 12, to heat the ice-making plate 10, thereby melting frozen faces between the ice-making surface and ice blocks M, and water at normal temperature (hereinafter referred to as "deicing water") is sprinkled onto the back surface of the ice-making plate 10 to facilitate removing of ice by raising the temperature of the back surface. For example, as shown in FIG. 1, a deicing water supply pipe 26 connected to an external water supply is connected to a deicing water sprinkler 28 provided at the top of the back surface of the ice-making plate 10, via a water supply valve WV. By opening the water supply valve WV during the deicing operation, deicing water supplied from the external water supply is sprinkled onto the back surface of the ice-making plate 10 through a large number of sprinkler holes formed in the deicing water sprinkler 28, and flows down to thereby melt the frozen faces between the ice-making plate 10 and ice blocks M. The deicing water having flowed down along the back surface of the ice-making plate 10 is collected by the ice-making water tank 20 via the through holes of the guide plate 18, similarly to the ice-making water. This deicing water is used as ice-making water next time.

The ice-making water tank 20 is equipped with an overflow pipe 32 so as to define the amount of ice-making water stored in the tank 20. More specifically, the tank 20 is configured such that deicing water (ice-making water) collected in the ice-making water tank 20 during the deicing operation in excess of a predetermined water level is caused to flow into the overflow pipe 32 from an upper end opening thereof, for being discharged out of the ice-making machine. It should be noted that the amount of deicing water supplied from the external water supply to the ice-making plate 10 during the deicing operation is set to a value larger than the amount of ice-making water stored in the tank 20, defined by the overflow pipe 32, so as to prevent shortage of next ice-making water. Therefore, deicing water collected in the tank 20 immediately before termination of the deicing operation is discharged out of the ice-making machine through the overflow pipe 32.

The ice-making water tank 20 has a float switch FS inserted therein. The float switch FS detects the height of a water surface in the tank 20, and is set such that if the water surface is higher than a preset specified water level WL, the float switch FS is switched ON, whereas if the water surface is lowered to the specified water level WL, the float switch FS is switched OFF. In the present embodiment, the ice-making operation is started at an upper water level defined by the overflow pipe 32, the water level in the tank 20 is lowered as ice blocks M are produced on the ice-making plate 10, and a lower water level indicated when the ice blocks M are completely produced is defined as the specified water level WL.

As shown in FIG. 1, in the refrigeration system 12, vaporized refrigerant compressed by a compressor CM, flowing through a discharge pipe 34, is condensed and liquefied by a condenser 36, decompressed by an expansion valve 38, caused to flow into the evaporator tube 14 where the refrigerant is expanded and evaporated all at once. Then, the refrigerant undergoes heat exchange with the ice-making plate 10 to thereby cool the ice-making plate 10 to a temperature below the freezing point. The refrigerant evaporated in the evaporator tube 14 to become vaporized refrigerant, returns to the compressor CM via a suction pipe 40, and repeats the above cycle.

Further, a hot gas pipe 42 branches from the discharge pipe 34 of the compressor CM. The hot gas pipe 42 communicates with an inlet side of the evaporator tube 14 via the hot gas valve HV. The hot gas valve HV is controlled to be opened only during the deicing operation, and closed during the ice-making operation. More specifically, the hot gas valve HV is opened during the deicing operation, to cause hot gas discharged from the compressor CM to be bypassed to the evaporator tube 14 via the hot gas pipe 42 to warm the ice-making plate 10, whereby the frozen faces of ice blocks M produced on the ice-making surface are melted to cause the ice blocks M to drop due to their own weights. It should be noted that the symbol FM in FIG. 1 represents a cooling fan for the condenser 36.

The suction pipe 40 connected to a refrigerant outlet side of the evaporator tube 14 has a temperature sensor 30 disposed in intimate contact with the suction pipe 40, as temperature-detecting means for detecting the outlet temperature of the refrigerant after termination of the heat exchange with the ice-making plate 10. The temperature detected by the temperature sensor 30 is inputted to a first control unit 44, described hereinafter.

Figure 2:
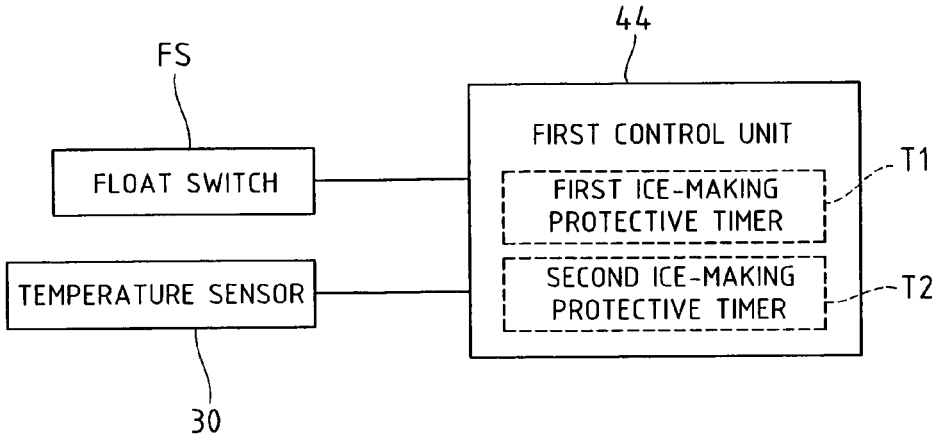
FIG. 2 is a block diagram schematically showing a control system for carrying out the operating method according to the first embodiment.

FIG. 2 shows a control system of the flowing-down type ice-making machine according the first embodiment. The ice-making machine includes the first control unit 44 implemented, for example, by a microcomputer that carries out centralized control of overall electrical control of the ice-making machine. To the control unit 44 are connected the float switch FS and the temperature sensor 30. After the ice-making operation is started, when the water surface in the ice-making water tank 20 is lowered to the specified water level VL, causing the float switch FS to be switched from ON to OFF (the specified water level WL to be detected), the first control unit 44 causes the ice-making operation to stop and be switched to the deicing operation. Further, the first control unit 44 is configured such that when the temperature sensor 30 detects that the temperature of hot gas, the temperature of which sharply rises when ice blocks M are released from the ice-making plate 10 warmed by the hot gas supplied to the evaporator tube 14 after the start of the deicing operation, has reached a deicing completion temperature set in advance, the first control unit 44 determines that deicing is completed to cause the deicing operation to stop and be switched to the ice-making operation.

The first control unit 44 includes a first ice-making protective timer T1 and a second ice-making protective timer T2. The ice-making protective timers T1 and T2 are set so as to start counting operations thereof simultaneously with the start of the ice-making operation. To the first ice-making protective timer T1 is set a first set time period (set time period) $t_1$ longer than a first normal time (normal time) tn1 which the temperature sensor 30 takes to detect a first preset temperature (e.g. 2° C.) K1 as a preset temperature which is set in advance, after the start of the ice-making operation in the state of the amount of refrigerant in the refrigeration system 12 being normal. Before the temperature sensor 30 detects the first preset temperature K1, if the first ice-making protective timer T1 counts up, i.e. if the first set time period $t_1$ has elapsed, the first control unit 44 determines that there has occurred the abnormal state of shortage of refrigerant, and causes the ice-making operation to be switched to the deicing operation (failsafe operation), even if the float switch FS has not detected the specified water level WL (see FIG. 4).

Figure 3:
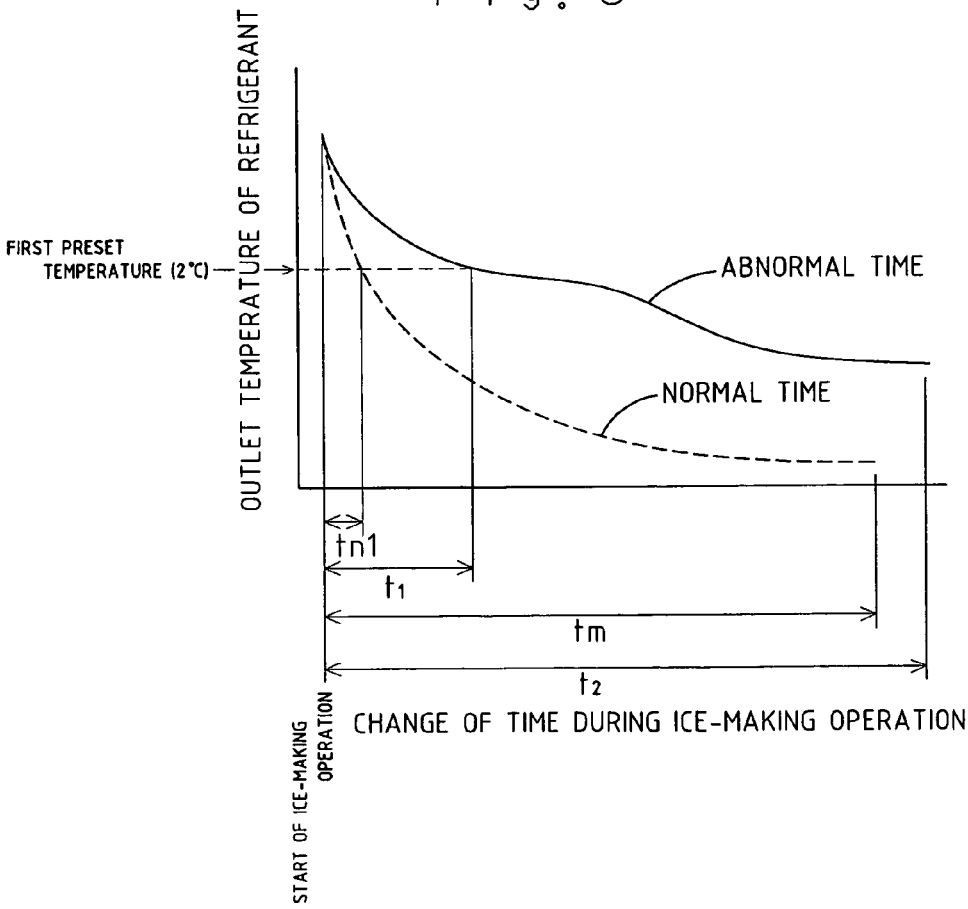
FIG. 3 is a graph showing the relationship between changes in temperature of a refrigerant outlet and time.

Now, assuming that the amount of refrigerant in the refrigeration system 12 becomes short, as shown in FIG. 3, the lowering rate of the outlet temperature of the refrigerant from the evaporator tube 14 becomes gentle. When the abnormal state as described above has occurred, a time which the outlet temperature of the refrigerant takes to reach the first preset temperature K1 after the start of the ice-making operation becomes longer than the first normal time tn1. This makes it possible to determine that there has occurred shortage of refrigerant, when the first ice-making protective timer T1 counts up before the temperature sensor 30 detects the first preset temperature K1.

Further, to the second ice-making protective timer T2 is set a second set time period $t_2$ longer than a normal ice-making time period tm which the float switch FS takes to detect the specified water level WL after the start of the ice-making operation in the state of the amount of refrigerant in the refrigeration system 12 being normal. The first control unit 44 is configured such that before the float switch FS detects the specified water level WL, if the second ice-making protective timer T2 counts up, i.e. when the second set time period $t_2$ has elapsed, the first control unit 44 determines that there has occurred an abnormality in the float switch FS or the ice-making water supply system, and immediately cause the ice-making operation to be switched to the deicing operation.

The first control unit 44 is configured such that it counts the number of times of counting operations of the first and second ice-making protective timers T1 and T2 in which they have fully counted the first set time period $t_1$ or the second set time period $t_2$, and when the counted number reaches a predetermined number, it stops the operation of the ice-making machine itself. In other words, the first control unit 44 does not count counting operations of the first and second ice-making protective timers T1 and T2 when the ice-making operation is switched to the deicing operation before the first and second ice-making protective timers T1 and T2 fully count the set time period $t_1$ or $t_2$ set thereto, to reset the set time periods $t_1$ and $t_2$.

As described above, the automatic ice-making machine according to the first embodiment includes the temperature sensor 30 for detecting the outlet temperature of the refrigerant from the evaporator tube 14, the first ice-making protective timer T1 which starts a counting operation thereof simultaneously with the start of the ice-making operation, and has the first set time period t1 set thereto, which is longer than the first normal time tn1 which the temperature sensor 30 takes to detect the first preset temperature K1 set in advance, in the state of the amount of refrigerant in the refrigeration system 12 being normal, and the first control unit 44 which when the first ice-making protective timer T1 terminates the counting operation before the temperature sensor 30 detects the first preset temperature K1, determines that there has occurred the abnormal state of shortage of refrigerant, and carries out the failsafe operation.

[Operation of the First Embodiment]

Next, the operation of the operating method for the automatic ice-making machine, according to the first embodiment, will be described with reference to a flowchart shown in FIG. 4.

Figure 4:
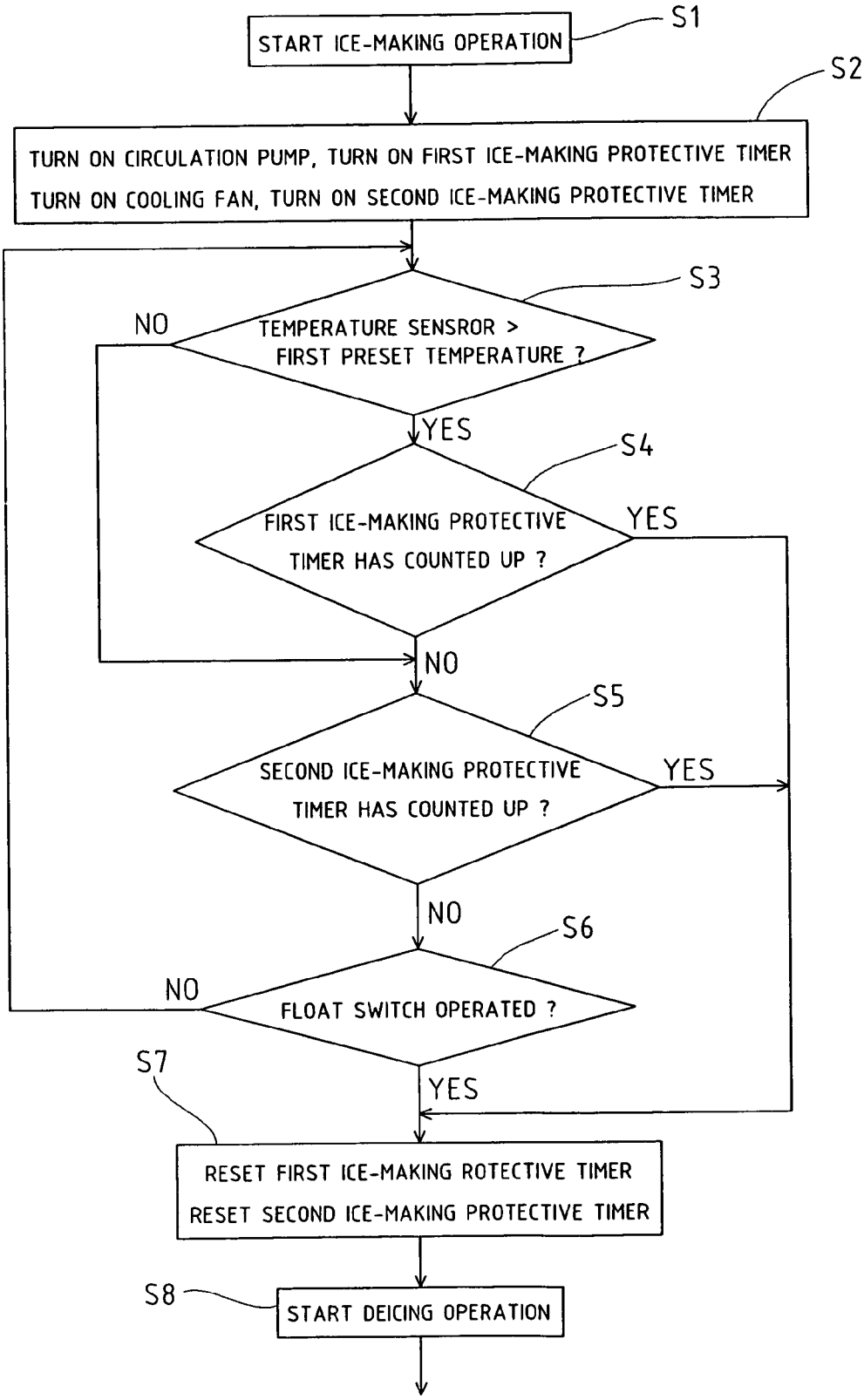
FIG. 4 is a flowchart showing the procedure of operations executed by the operating method according to the first embodiment.

In FIG. 4, when the ice-making operation of the ice-making machine is started in step S1, the circulation pump PM and the cooling fan FM are started (turned ON), and the first and second ice-making protective timers T1 and T2 start counting operations (are turned ON) in step 2. It should be noted at this time, ice-making water is stored in the ice-making water tank 20 up to the upper water level defined by the overflow pipe 32, while the float switch FS is ON.

When the ice-making operation is started, the ice-making plate 10 undergoes heat exchange with the refrigerant circulating within the evaporator tube 14 to be forcibly cooled, whereby ice-making water supplied from the ice-making water tank 20 to the ice-making surface of the ice-making plate 10 by the circulation pump PM starts to be progressively frozen. It should be noted that ice-making water dropped from the ice-making surface without freezing is collected in the ice-making water tank 20 via the through holes of the guide plate 18, and supplied to the ice-making plate 10 again.

Then, the process proceeds to step S3, wherein it is checked whether or not the outlet temperature of the refrigerant from the evaporator tube 14 detected by the temperature sensor 30 is higher than the first preset temperature K1. If the outlet temperature of the refrigerant from the evaporator tube 14 has not yet reached the first preset temperature K1, the answer to the question of step S3 is determined to be affirmative (YES), followed by the process proceeding to step S4. In step S4, it is checked whether or not the first ice-making protective timer T1 has counted up the first set time period $t_1$ (whether or not the first set time period $t_1$ has elapsed). If the answer to this question is negative (NO), the process proceeds to the next step 5. That is, if the outlet temperature of the refrigerant has not reached the first preset temperature K1, and at the same time, the first ice-making protective timer T1 has not counted up the first set time period $t_1$, the first control unit 44 determines that there has not occurred the abnormal state of shortage of refrigerant, and causes the ice-making operation to be continued. It should be noted that if the answer to the question of step S3 is negative (NO), i.e. if the outlet temperature of the refrigerant has reached the first preset temperature K1, the process proceeds to step 5 without carrying out determination of step S4.

In the above step S5, it is checked whether or not the second ice-making protective timer T2 has counted up the second set time period $t_2$ (whether or not the second set time period $t_2$ has elapsed). If the answer to this question is negative (NO), the process proceeds to step 6, wherein it is checked whether or not the float switch FS has detected the specified water level WL (whether or not the float switch FS has been switched from ON to OFF). If the answer to this question is negative (NO), the program returns to step S3, wherein the above-described flow is repeatedly carried out. If the answer to the question of step S6 is determined to be affirmative (YES), the first control unit 44 determines that normal ice-making operation has been executed. Then, the process proceeds to step S7, wherein the first and second ice-making protective timers T1 and T2 are reset. After that, in step S8, the ice-making operation is stopped so as to start the deicing operation.

When the deicing operation is started, the hot gas valve HV is opened to circulate and supply hot gas through the evaporator tube 14. Further, the water supply valve WV is opened, whereby deicing water is fed from the external water supply to the back surface of the ice-making plate 10. By this deicing operation, ice blocks are completely released from the ice-making plate 10, and when a rise in the temperature of the hot gas (deicing completion temperature) is detected by the temperature sensor 30, the first control unit 44 terminates the deicing operation to start the ice-making operation.

On the other hand, in the above flow during the ice-making operation, if the answer to the question of step S4 is determined to be affirmative (YES), which means the first set time period $t_1$ of the first ice-making protective timer T1 set to be longer than the first normal time tn1 has elapsed, in spite of the temperature sensor 30 having not yet detected the first preset temperature K1, in this case, the first control unit 44 determines that there has occurred the abnormal state of shortage of refrigerant. Then, the process proceeds to step S7, wherein the first and second ice-making protective timers T1 and T2 are reset, and in step S8, the ice-making operation is stopped to start the deicing operation. That is, when the abnormal state of shortage of refrigerant has occurred, the ice-making operation is forcibly switched to the deicing operation even during execution of the ice-making operation, so that the ice-making operation is prevented from being continued with no sufficient refrigerant. Further, since the first set time period $t_1$ set to the first ice-making protective timer T1 is shorter than the aforementioned normal ice-making time period tm, it is possible to detect occurrence of the abnormal state in a shorter time period, thereby making it possible prevent the compressor CM or the like from being damaged by the ice-making operation continued for a long time period in the state of shortage of refrigerant.

Next, if the answer to the question of step S5 is affirmative (YES), i.e. if the second set time period $t_2$ has elapsed before the float switch FS detects the specified water level WL, the first control unit 44 determines that the normal ice-making operation is not being carried out due to abnormality occurring in the float switch FS or the ice-making water supply system, resets the first and second ice-making protective timers T1 and T2 in step S7, and then forcibly stops the ice-making operation to start the deicing operation in step S8. That is, when abnormality has occurred in the float switch FS or the like, the ice-making operation is forcibly switched to the deicing operation even during execution of the ice-making operation, so that the ice-making operation is prevented from being continued with the abnormal state left unsolved.

The first control unit 44 counts the number of times that the answers to the questions of step S4 and step S5 are determined to be affirmative (YES) (the number of times that the first and second ice-making protective timers T1 and T2 have counted up without being reset in the course of their counting operations), and causes the ice-making machine to stop the operation thereof when the counted number has reached a preset number. That is, the ice-making machine can be prevented from continuing operation when the normal ice-making operation cannot be carried out due to occurrence of shortage of refrigerant or abnormality in the float switch FS or the like, to thereby suppress useless electric power consumption. Accordingly, it is possible to prevent the ice-making plate 10 from being damaged by part of ice blocks M which remains on the ice-making plate 10 without being released therefrom, during deicing operation, due to variation in volume of the produced ice blocks M which were produced on the ice-making plate 10 during the ice-making operation, or further by continuing the operation of the compressor CM in the state of shortage of refrigerant. Further, in the first embodiment, since occurrence of the abnormal state is detected using the temperature sensor 30 that detects completion of the deicing operation, there is no need to provide new detection means, which makes it possible to simplify the control system to reduce manufacturing costs of the ice-making machine.

(Variation of the First Embodiment)

Although in the first embodiment described above, the ice-making machine is controlled to stop the operation thereof by counting the number of times that the first and second ice-making protective timers T1 and T2 have counted up without being reset in the course of their counting operations, the failsafe operation to be carried out when an abnormal state occurs is not limited to this. For example, the control system may be configured to stop the operation of the ice-making machine immediately after the first ice-making protective timer T1 has counted up, or immediately after either of the first and second ice-making protective timers T1 and T2 has counted up the first or second set time period $t_1$ or $t_2$, and the ice-making operation is switched to the deicing operation to complete the deicing operation. Further, the first preset temperature K1, the first normal time tn1, the first set time period $t_1$, the second set time period $t_2$, and the normal ice-making time period tm may be set to respective optimum values depending on an environment where the ice-making machine is installed. It should be noted that the construction of the ice-making section is not limited to that of the ice-making section formed by a single ice-making plate 10, as in the above-described embodiment. For example, the ice-making section may be of a type in which the evaporator tube 14 is held by two ice-making plates, or alternatively of a type in which ice-making water is supplied to a large number of ice-making small chambers open downward or sideward for producing ice blocks in the small chambers.

(Second Embodiment)

Figure 5:
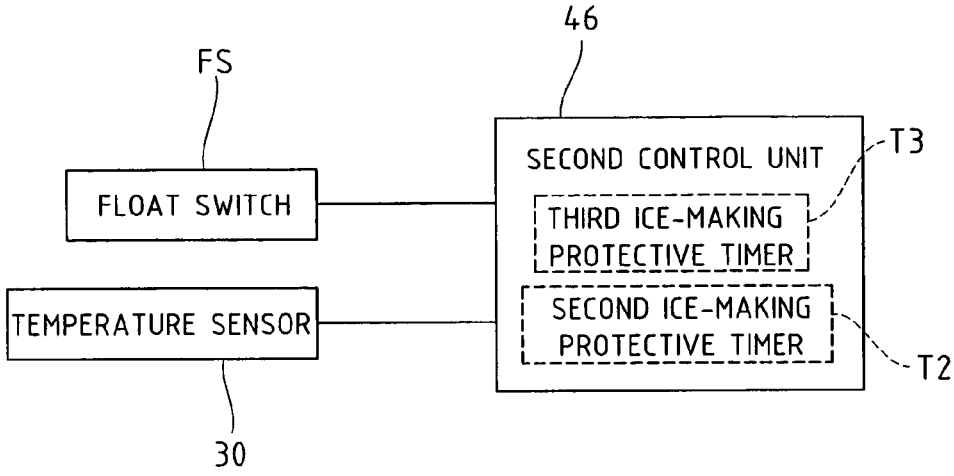
FIG. 5 is a block diagram schematically showing a control system for carrying out an operating method according to a second embodiment of the present invention.

FIG. 5 shows a control system of a flowing-down type ice-making machine according to the second embodiment of the present invention. It should be noted that the basic construction of the ice-making machine is the same as that of the ice-making machine according to the first embodiment, so that description will be given only of component parts different in construction from the first embodiment, while component elements identical to those of the first embodiment are designated by the same reference numerals, and detailed description thereof is omitted.

A second control unit 46 incorporated in the ice-making machine according to the second embodiment has the aforementioned float switch FS and temperature sensor 30 connected thereto and includes a second ice-making protective timer T2 and a third ice-making protective timer T3. Similarly to the first embodiment, to the second ice-making protective timer T2 is set a second set time period $t_2$, and the timer T2 is configured to start a counting operation thereof simultaneously with the start of ice-making operation. To the third ice-making protective timer T3 is set a third set time period $t_3$ longer than a second normal time (normal time) tn2 which the temperature sensor 30 takes to detect a second preset temperature (e.g. −5° C.) K2 lower than a first preset temperature (e.g. 2° C.) K1 set in advance, after detecting the first preset temperature K1, after the ice-making operation is started in the state of the amount of refrigerant in the refrigeration system 12 being normal. Further, the third ice-making protective timer T3 is configured to start a counting operation thereof simultaneously with the detection of the first preset temperature K1 by the temperature sensor 30.

Figure 7:
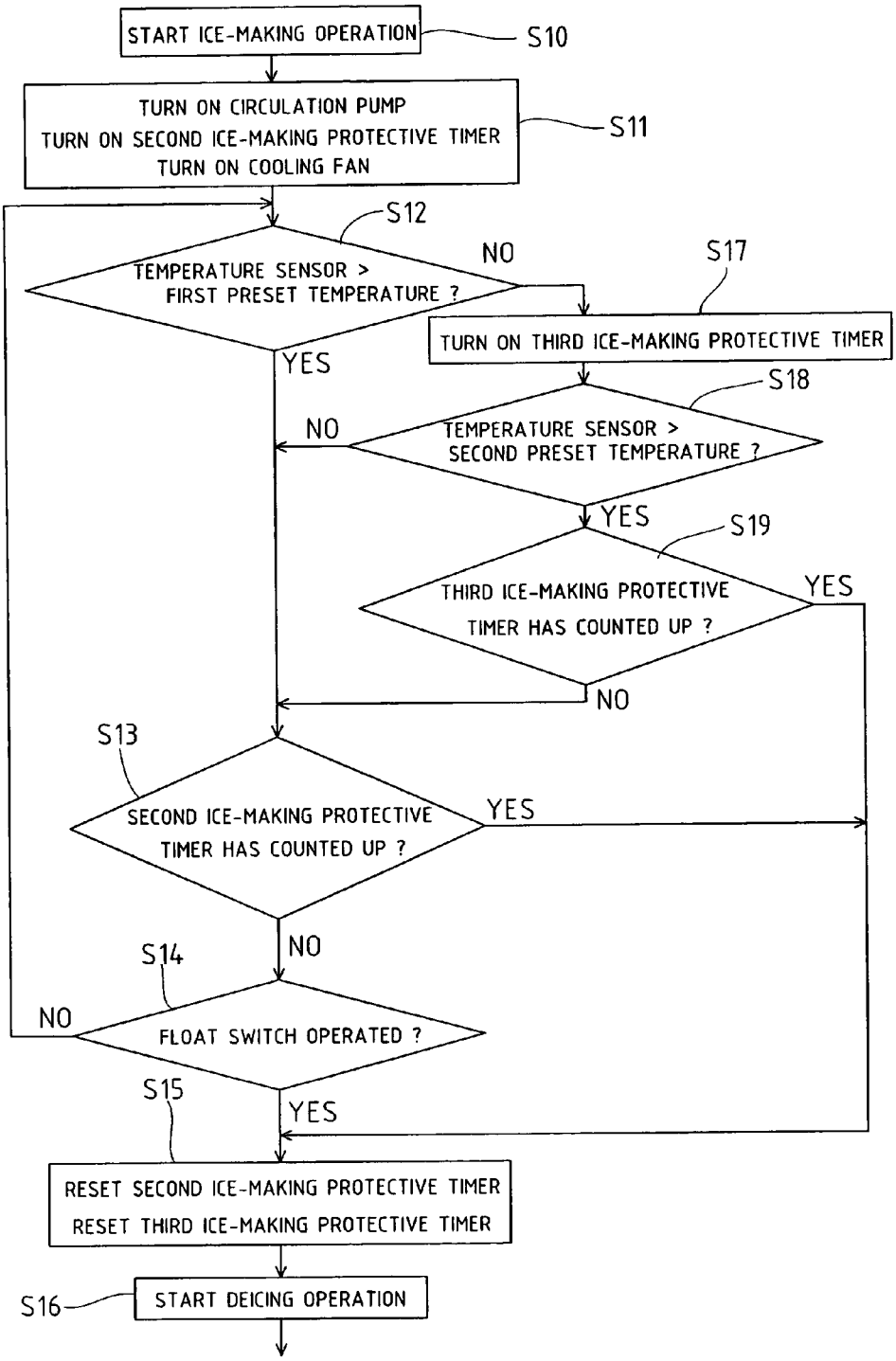
FIG. 7 is a flowchart showing the procedure of operations executed by the operating method according to the second embodiment.

The second control unit 46 is configured such that when the third ice-making protective timer T3 has counted up, i.e. the third set time period $t_3$ has elapsed, before the temperature sensor 30 detects the second preset temperature K2, the second control unit 46 determines that the abnormal state of shortage of refrigerant has occurred, and causes the ice-making operation to be switched to a deicing operation (failsafe operation), even when the temperature sensor 30 has not yet detected the specified water level WL (see FIG. 7).

Figure 6:
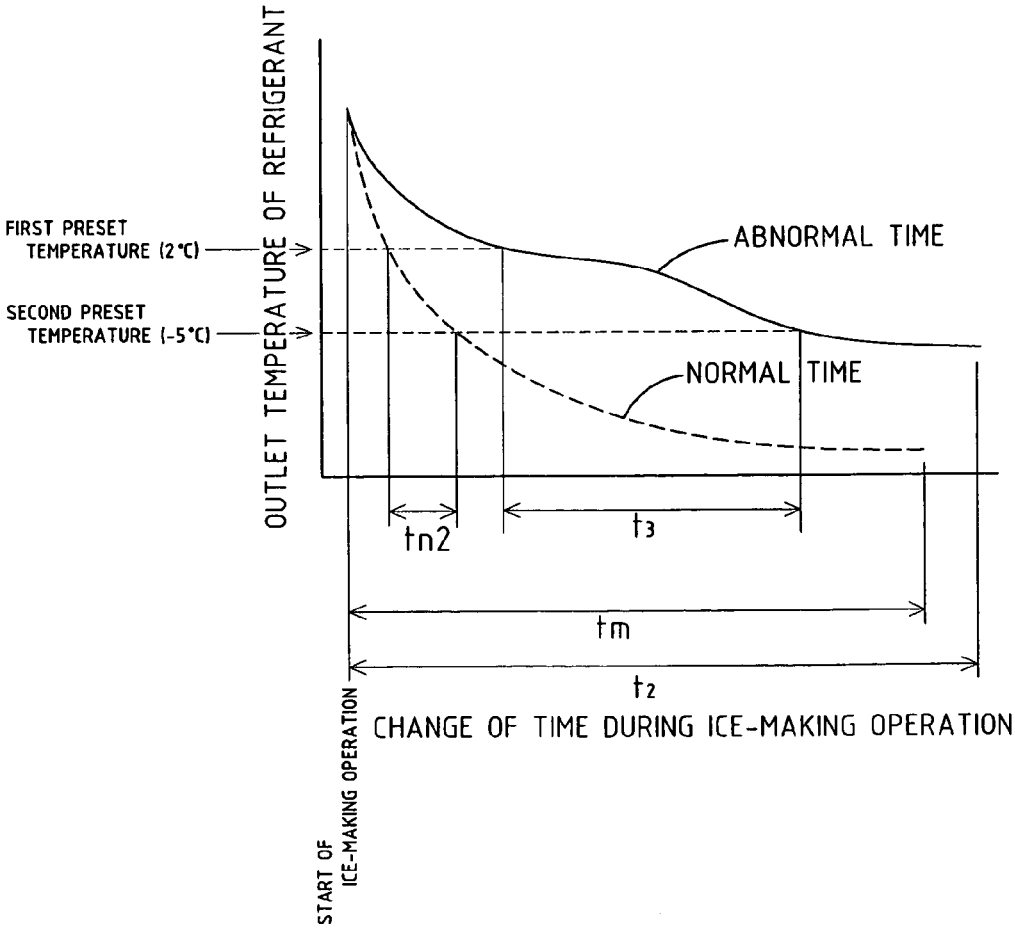
FIG. 6 is a graph showing the relationship between changes in temperature of a refrigerant outlet and time.

Now, when the amount of refrigerant in the refrigeration system 12 becomes short, as shown in FIG. 6, the lowering rate of the outlet temperature of the refrigerant from the evaporator tube 14 becomes gentle. When the abnormal state as described above has occurred, a time which the outlet temperature of the refrigerant takes to reach the second preset temperature K2 from the first preset temperature K1 becomes longer than the second normal time tn2. This makes it possible to determine that there has occurred shortage of refrigerant, when the third ice-making protective timer T3 counts up before the temperature sensor 30 detects the second preset temperature K2.

More specifically, the automatic ice-making machine according to the second embodiment includes the temperature sensor 30 for detecting the outlet temperature of the refrigerant from the evaporator tube 14, the third ice-making protective timer T3 to which is set the third set time period $t_3$ longer than the second normal time tn2 which the temperature sensor 30 takes to detect the second preset temperature K2 lower than the first preset temperature K1 set in advance, after detecting the first preset temperature K1 in the state of the amount of refrigerant in the refrigeration system 12 being normal, and the second control unit 46 which determines that there has occurred an abnormal state of shortage of refrigerant, to execute the failsafe operation, when the third ice-making protective timer T3 that starts the counting operation thereof when the temperature sensor 30 detects the first preset temperature K1 terminates the counting operation before the temperature sensor 30 detects the second preset temperature K2.

(Operation of the Second Embodiment)

Next, the operation of the operating method of the automatic ice-making machine, according to the second embodiment, will be described with reference to a flowchart shown in FIG. 7. It should be noted that description of similar operations as described as to the first embodiment is omitted.

In FIG. 7, when the ice-making operation of the ice-making machine is started in step S10, the circulation pump PM and the cooling fan FM are started (turned ON), and the second ice-making protective timer T2 starts its counting operation (is turned ON) in step S11. By this ice-making operation, ice blocks M are produced on the ice-making plate 10.

Then, the process proceeds to step S12, wherein it is checked whether or not the outlet temperature of the refrigerant detected by the temperature sensor 30 is higher than the first preset temperature K1. If the outlet temperature of the refrigerant from the evaporator tube 14 has not yet reached the first preset temperature K1, the answer to the question of step S12 is determined to be affirmative (YES), followed by the process proceeding to a next step S13. In step S13, it is checked whether or not the second ice-making protective timer T2 has counted up (whether or not the second set time period $t_2$ has elapsed). If the answer to this question is negative (NO), the process proceeds to a next step 14. In step S14, it is checked whether or not the float switch FS has detected the specified water level WL (whether or not the float switch FS has been switched from ON to OFF). If the answer to this question is negative (NO), the program returns to step S12, to repeatedly carry out the above-described flow. If the answer to the question of step S14 is determined to be affirmative (YES), the second control unit 46 determines that normal ice-making operation has been executed. Then, the process proceeds to step S15, wherein the second and third ice-making protective timers T2 and T3 are reset. After that, in step S16, the ice-making operation is stopped so as to start the deicing operation.

On the other hand, in the above flow during the ice-making operation, if the answer to the question of step S12 is determined to be negative (NO) due to detection of the first preset temperature K1 by the temperature sensor 30, the process proceeds to step S17, wherein the third ice-making protective timer T3 starts its counting operation (is turned ON). Then, in step S18, it is checked whether or not the outlet temperature of the refrigerant detected by the temperature sensor 30 is higher than the second preset temperature K2. If the outlet temperature of the refrigerant has not yet reached the second preset temperature K2, the answer to the question of step S18 is determined to be affirmative (YES), and the process proceeds to a next step S19. In step S19, it is checked whether or not the third ice-making protective timer T3 has counted up (whether or not the third set time period $t_3$ has elapsed). If the answer to this question is negative (NO), the process proceeds to the above step 13. That is, if the outlet temperature of the refrigerant has not reached the second preset temperature K2, and at the same time the third ice-making protective timer T3 has not counted up, the second control unit 46 determines that there has not occurred the abnormal state of shortage of refrigerant, and causes the ice-making operation to be continued. It should be noted that if the answer to the question of step S18 is negative (NO), i.e. if the outlet temperature of the refrigerant has reached the second preset temperature K2, the process proceeds to step 13 without carrying out determination of step S19.

Then, if the answer to the question of step S19 is determined to be affirmative (YES), which means that the third set time period $t_3$ of the third ice-making protective timer T3 set to be longer than the second normal time tn2 has elapsed, in spite of the temperature sensor 30 having not yet detected the second preset temperature K2, in this case, the second control unit 46 determines that there has occurred the abnormal state of shortage of refrigerant. Then, the process proceeds to step S15, wherein the second and third ice-making protective timers T2 and T3 are reset, and in step S16, the ice-making operation is stopped to start the deicing operation. In other words, when the abnormal state of shortage of refrigerant has occurred, the ice-making operation is forcibly switched to the deicing operation even during execution of the ice-making operation, so that the ice-making operation is prevented from being continued in the state of shortage of refrigerant. Further, since the third set time period $t_3$ set to the third ice-making protective timer T3 is shorter than the normal ice-making time period tm described above, it is possible to detect occurrence of the abnormal state in a shorter time period, thereby making it possible prevent the compressor CM or the like from being damaged by the ice-making operation continued for a long time period in the state of shortage of refrigerant.

It should be noted that similarly to the first embodiment, the second control unit 46 counts the number of times that the answers to the questions of step S13 and step S14 are determined to be affirmative (YES) (the number of times that the second and third ice-making protective timers t2 and T3 have counted up without being reset in the course of their counting operations), and causes the ice-making machine to stop the operation thereof when the counted number has reached a preset number. Thus, in the case of the second embodiment as well, the same advantageous effects as provided by the first embodiment can be obtained.

(Variation of the Second Embodiment)

The above-described second embodiment can employ the aforementioned variation of the first embodiment as required. Further, the second preset temperature K2, the second normal time tn2, and the third set time period $t_3$ may be also set to respective optimum values depending on an environment where the ice-making machine is installed.

In the operating method of the automatic ice-making machine, according to the present invention, failsafe operation, for example, to stop the ice-making operation, when shortage of refrigerant is detected, whereby it is possible to suppress wasteful electric power consumption. Further, since the ice-making operation can be prevented from being continued in the state of shortage of refrigerant, it is possible to prevent the ice-making section and the compressor from being damaged.

The invention claimed is:

1. A method for operating an automatic ice-making machine that alternately and repeatedly carries out an ice-making operation for producing ice blocks by cooling an ice-making section on which an evaporator connected to a refrigeration system is disposed and by supplying refrigerant to said evaporator for circulation, and a deicing operation for causing the ice blocks produced on said ice-making section to be released therefrom, wherein during the ice-making operation, when time in which an outlet temperature of the refrigerant from said evaporator takes to reach a preset temperature, after a start of the ice-making operation, is longer than a normal time in which the outlet temperature of the refrigerant from said evaporator takes to reach the preset temperature, an abnormal state of shortage of the refrigerant is determined and a failsafe operation is carried out.

2. A method for operating an automatic ice-making machine that alternately and repeatedly carries out an ice-making operation for producing ice blocks by cooling an ice-making section on which an evaporator connected to a refrigeration system is disposed and by supplying refrigerant to said evaporator for circulation, and a deicing operation for causing the ice blocks produced on said ice-making section to be released therefrom, wherein during the ice-making operation, when time in which an outlet temperature of the refrigerant from said evaporator takes to reach a second preset temperature from a first preset temperature is longer than a normal time in which the outlet temperature of the refrigerant from said evaporator takes to reach the second preset temperature, an abnormal state of shortage of the refrigerant is determined and a failsafe operation is carried out.

* * * * *